US005904626A

United States Patent [19]

Fendel et al.

[11] Patent Number: 5,904,626

[45] Date of Patent: May 18, 1999

[54] LIGHT-WEIGHT HANDLE

[76] Inventors: Edwin B. Fendel, 487 Pepperridge Tree Ter., Kinnelon, N.J. 07405; Albert B. Ferraro, 30 E. Bradford Ave., Cedar Grove, N.J. 07009; Alfred J. Greene, Jr., 92 Bender Dr., Clifton, N.J. 07013

[21] Appl. No.: 08/870,625

[22] Filed: Jun. 6, 1997

[51] Int. Cl.[6] ..... A63B 53/14

[52] U.S. Cl. ..... 473/296; 473/298; 473/552; 473/409; 273/DIG. 7; 273/DIG. 23

[58] Field of Search ..... 473/296–299, 473/238–239, 308, 552, 409; 273/DIG. 7, DIG. 23

[56] References Cited

U.S. PATENT DOCUMENTS

| | | | |
|---|---|---|---|
| 1,605,552 | 11/1926 | Mattern | 473/308 |
| 1,611,925 | 12/1926 | Link | 473/298 |
| 1,670,531 | 5/1928 | Cowdery | 473/323 |
| 3,614,101 | 10/1971 | Hunter | 473/316 |
| 4,097,626 | 6/1978 | Tennent | 273/DIG. 23 |
| 4,288,075 | 9/1981 | Kaugars | 473/323 |
| 4,455,022 | 6/1984 | Wright | 273/DIG. 7 |
| 4,836,545 | 6/1989 | Pompa | 473/320 |
| 5,253,867 | 10/1993 | Gafner | 473/320 |
| 5,390,921 | 2/1995 | De Ruyter | 473/299 |

*Primary Examiner*—Sebastiano Passaniti
*Assistant Examiner*—Stephen L. Blau
*Attorney, Agent, or Firm*—Synnestvedt & Lechner

[57] ABSTRACT

A light-weight handle is disclosed for use on new or existing golf clubs regardless of their shaft material. The handle comprises an elongated tubular member having a radially expanded gripping surface and a way for attaching the handle to a golf club shaft.

5 Claims, 3 Drawing Sheets

LIGHT-WEIGHT HANDLE

BACKGROUND OF THE INVENTION

1. Field of Invention

This invention relates generally to golf clubs and, more particularly, to a light-weight handle for improving a club's performance.

2. Background

There is an ongoing desire to improve the performance of golf clubs. A modern golf club typically comprises a head connected to a shaft, and a grip attached over a length of the shaft opposite the head. The grip is typically a relatively thick sleeve of molded rubber having an outer diameter that is substantially larger than the shaft diameter so that the grip fits comfortably and securely in the hands of the golfer. Furthermore, the grip usually has a tapered profile. It tapers from a relatively large diameter at the butt end to a relatively small diameter at the other end where the club shaft emerges from the grip. The tapered profile acts like a conical wedge to prevent the club from leaving the hands of the golfer during the swing due to the centrifugal force.

One important parameter affecting golf club performance is its mass distribution. For a golf club of a given mass, the mass distribution determines how much momentum can be imparted to the ball. The greater the imparted momentum, the farther the ball will travel. The center of gravity of the club is one measure of the mass distribution, and is the point where all of the mass of the object can be considered to be concentrated. The closer the center of gravity is to the head of the club, the more effective the mass of the club is in imparting momentum to the ball.

Another important parameter affecting golf club performance is club weight. Heavier clubs tend to be more difficult to accelerate than lighter clubs. Lower acceleration equates to lower swing velocity. Swing velocity is an important factor in driving a ball: for clubs of similar weight and mass distribution, the greater the swing velocity, the farther the ball will travel. Therefore, lighter clubs are preferable from the perspective of swing velocity.

Efforts to improve a club's performance have been focused generally on reducing shaft weight. To this end, a family of clubs having graphite composite shafts has been developed. The high strength to weight ratio of graphite provides for shafts with the strength of steel, but without the weight.

In addition to lightening the shaft, a more recent advance is the elimination of the grip. Although the molded rubber-grip is a highly standardized component of the modern club, its weight has a detrimental effect on the club's performance. It is a relatively heavy part of the club, representing, for example, about 15% of the total mass of a typical driver or any fairway wood. Furthermore, due to the grip's position at the end of the shaft, its weight has a major detrimental influence on both the total weight of the club and its center of gravity. These detrimental effects are amplified for an over-sized grip which are used commonly by people with arthritis or large hands.

The elimination of the conventional grip in these new clubs with gripless graphite shafts is made possible by the molding flexibility of graphite fibers. That is, the diameter of the shaft toward the end opposite the head increases to approximately the size and shape of a conventional grip. By expanding the end of the shaft this way, a user is able to grasp it directly without the need for a grip.

Although graphite shafts tend to reduce shaft weight and can be molded to eliminate the need for a grip, the torsional stiffness of a graphite-shaft is significantly less than that of a steel shaft. For example, for a right-handed golfer, the lower torsional stiffness of a graphite-shaft allows the club head to rotate clockwise about the shaft axis upon impact with the ball. Consequently, the club face does not meet the ball squarely, but rather "toes out" during impact and transfers momentum to the ball at an angle. This causes the ball to veer to the right of its intended path.

The characteristic inaccuracy associated with graphite shafts can be mitigated by angling the face of the golf club's head in a direction opposite of the shaft's twist. For example, the club face would have a counterclockwise angle for a right-handed club. This angle compensates for the shaft's torsional twist such that, upon impact, the club's momentum transfers substantially squarely to the bal. Such compensation, however, is imprecise. The amount of compensation varies not only according to the user, but also according to the strength of a user's particular swing. Consequently, serious golfers prefer not to rely on such compensation. In general, professional golfers do not use graphite shaft clubs but rather continue to use clubs with steel shafts.

The problems facing graphite-shaft clubs also face the new gripless clubs since such clubs, for practical purposes, are restricted to graphite shafts. It is the flexibility of graphite fiber fabrication that enables a shaft to be molded such that the end opposite the head has a size and shape suitable for a user to grip. Attempting to swage a steel shaft to such a form as taught in U.S. Pat. No. 3,809,403 is difficult, if not impossible, because the reduction in diameter from the shaft's gripping portion to the body of the shaft is too great for conventional swaging. It is unlikely that a steel shaft of the thickness typically used could be swaged, using conventional methods, to the dimensions indicated without crenelating. Thus, to realize the benefits of a gripless club, a new gripless graphite-shaft club must be purchased.

Therefore, a need exists to reduce the weight of the club and lower its center of gravity toward the head independent of the shaft material used. This need applies to both new and existing clubs. The present invention fulfills this need among others.

SUMMARY OF THE PRESENT INVENTION

The present invention-provides for a light-weight handle that can be incorporated into new golf clubs or retro-fitted to existing golf clubs regardless of the club's shaft material. Like the gripless club described above, the light-weight handle eliminates the need for a relatively heavy grip, and thus reduces the weight of the club and favorably alters its mass distribution by moving the center of gravity toward the club's head.

One aspect of the invention is a replacement light-weight handle for existing clubs. Thus, rather than discarding his or her existing clubs, a user can retro-fit them with the light-weight handle. The elimination of the grip and the under-laying section of shaft reduces club weight and lowers its center of gravity thereby improving its performance.

Another aspect of the present invention is a club having a light-weight handle and a shaft comprised of a torsionally rigid material such as steel. Thus, a user can retain the torsional stiffness of a steel shaft while enjoying a lighter club with a lower center of gravity previously only realized with graphite-shaft clubs.

A further aspect of the invention is a new or existing graphite shaft club to which the light weight handle is attached. The user enjoys the performance associated with a gripless graphite shaft club with its significantly lower weight and lowered center of gravity.

Still another aspect of the invention is a light-weight handle that can be configured to according to a user's particular preference. For example, if the user has large hands or arthritis, a handle with an over-sized gripping surface may be used. Unlike previous oversized grips, however, the light-weight handle of the present invention can be enlarged without a significant increase in weight. Thus, a user can benefit from a club having not only a large grip, but also improved performance.

Yet another aspect of the present invention is a method of retro-fitting the handle to an existing golf club.

In a preferred embodiment, the handle comprises a light-weight, tubular member with an outer surface radially expanded to approximate the size and shape of the outer surface of a traditional rubber-grip. The tubular construction and large diameter of the handle provides for relatively high torsional stiffness since torsional stiffness is proportional to the fourth power of the radius of a circular section. The handle may be comprised of a variety of materials that combine strength and light-weight, such as steel alloys, ceramics, plastics and composite materials. The tubular member should weigh less than the combination of both the conventional grip (50 g) and the underlaying section of shaft which it eliminates (22g). Therefore, the weight of the tubular member should be less than 72 g, and preferably less than 50 g, and more preferably less than 40 g, and even more preferably less than 35 g.

The relatively large diameter of the handle fits comfortably in the golfer's hand, and when the handle is provided with a tapered profile, it affords the same conical wedging action as a traditional rubber-grip. The outer gripping surface of the handle is preferably enhanced to improve a user's grip by increasing the friction between a user's hands and the handle. In the preferred embodiment, this enhancement is achieved by covering the handle with a thin tape wrap. It is advantageous to use tape having a surface which absorbs perspiration and is tacky to the touch.

One end of the handle has attachment means for facilitating interengagement between the handle and the club shaft. The attachment means can vary and may comprise any conventional mechanism for connecting two tubular objects together. A suitable attachment means may include an interface that cooperates with the handle and shaft to facilitate interengagement. In a preferred embodiment, the interface mechanically engages the handle and shaft through, for example, an interference fit, screw engagement (cooperating threads), snapping or latching engagement, crimping engagement, and spline and groove engagement, and combinations thereof. Alternatively or jointly, other means of connection can be used such as welding, brazing, soldering, and adhesives or fasteners, and combinations of two or more thereof. For example, the attachment means may comprise a cylindrical stump extending from the first end of the handle and dimensionally configured to matingly interfit along a predetermined engagement length of the club's shaft. To secure the stump to the shaft, an adhesive such as epoxy can be used.

Existing golf clubs can be retro-fitted with replacement handles by first removing the grip and a segment of the shaft. The segment of shaft removed should be sufficient in length such that, after the handle is added, the club has the desired over-all length. Next, the handle is attached to the shaft by one of the means outlined above. Optionally, the gripping surface of the handle is treated with a surface enhancer to increase the user's grip. New clubs can be manufactured with the light-weight handle by producing a shaft of the proper length for the particular club, attaching the head using means well known in the art, and attaching the handle by one of the means outlined above.

BRIEF DESCRIPTION OF THE DRAWINGS

The features of the present invention, which are believed to be novel, are set for with particularity in the appended claims. The invention may best be understood by reference to the following description taken in conjunction with the accompanying drawings, wherein like reference numerals identify like elements, and wherein:

DETAILED DESCRIPTION OF THE PRESENT INVENTION

Figure 1:
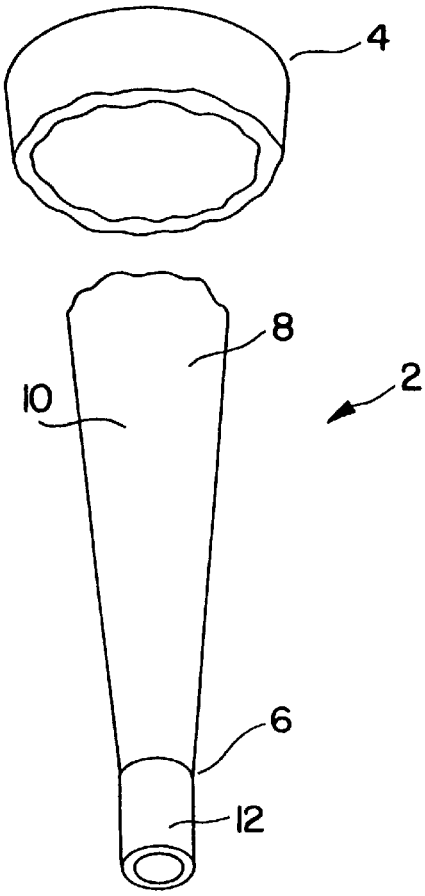
FIG. 1 shows an isometric view of an embodiment of a handle according to the invention.

The present invention provides a light-weight handle for use with new or existing golf clubs regardless of the shaft material used. In a preferred embodiment, the handle comprises: (a) an elongated tubular member having a predetermined length, first and second ends, and a gripping surface dimensionally configured for gripping by a user; and (b) an attachment means disposed proximate to the first end, the attachment means being interengagable with the end of the shaft opposite of the head for connecting the handle to the shaft.

An important aspect of the elongated tubular member is its gripping surface. The gripping surface eliminates the need for a traditional "grip" that adds a considerable amount of weight to the club and raises the club's center of gravity away from the head. The gripping surface should have a size and shape to accommodate a user's grip. This includes conventional grip configurations as well as custom configurations to meet a user's particular requirements.

In one embodiment, the gripping surface has a size and shape substantially similar to conventional grips. Although variations exist throughout the industry, a conventional grip is about 10.0 to about 10.5 inches in length with a single longitudinal axis. The gripping surface typically has an outer diameter at its largest point of at least about 0.8 inch. Furthermore, conventional grips are usually tapered such that the second end has a cross-sectional area greater than that of the first end. This taper may be either linear or non-linear. A preferred taper is approximately 0.03 inches/inch. In a more preferred embodiment, the taper is greater near the second end of the handle thus forming a "trumpeted" butt. Such profiles are well known in the manufacture of grips. An exemplary profile along the length of a conventional grip is provided below in Table 1.

TABLE 1

CONVENTIONAL GRIP PROFILE

| Distance from Butt end of Handle (in.) | Diameter (in.) |
|---|---|
| 0.00 | 1.100 |
| 0.25 | 1.100 |
| 0.50 | 1.045 |
| 0.75 | 1.005 |
| 1.00 | 0.975 |
| 1.50 | 0.935 |
| 2.00 | 0.928 |
| 2.50 | 0.890 |
| 3.00 | 0.865 |
| 3.50 | 0.865 |
| 4.00 | 0.850 |
| 4.50 | 0.835 |
| 5.00 | 0.825 |
| 5.50 | 0.815 |
| 6.00 | 0.815 |
| 6.50 | 0.800 |
| 7.00 | 0.785 |
| 7.50 | 0.785 |
| 8.00 | 0.770 |
| 8.50 | 0.750 |
| 9.00 | 0.730 |
| 9.50 | 0.720 |

Another embodiment of the invention comprises a gripping surface configured for a user's particular needs. This includes oversized handles, undersized handles, handles having cross-sectional areas other than circular, handles having more than one longitudinal axis, curved handles, handles having grooves, ridges, and/or bumps, and other handles having a size or form that a particular user may prefer. For example, if the user has large hands or arthritis, he or she may prefer a gripping surface larger than a conventional grip.

The handle of the present invention is particularly well-suited for an extra-large gripping surface because as the diameter of the handle increases so does its rigidity. Consequently, thinner wall construction is possible which reduces weight. Therefore, unlike the prior art, a larger grip can be used with little or no added weight.

To enhance gripping, the gripping surface may be treated to increase friction with the user's hands. Suitable treatments include, for example, texturing, mild adhesives or sticky coatings, and thin tapes. In a preferred embodiment, the treatment comprises a thin tape wrapping comprising a polymer surface which absorbs perspiration and is tacky to the touch. An example of such tape that is commercially available is traded under the brand name of GAMMA ULTRA SPONGE OVERGRIP® (GAMMA SPORTS®, Pittsburgh, Pennsylvania). It should be noted that the preferred surface treatment adds little weight and thickness to the handle. For example, a preferred tape wrapping may only ad from about 5 to about 15 g to the handle and have a thickness from about 0.010 to about 0.050 in.

To reduce club weight and lower the center of gravity, the elongated tubular member must weigh less than the combination of the grip and the underlaying shaft segment for which it is a substitute. The combined weight of the grip and the underlaying shaft portion in a conventional club is about 72 g. Therefore, to be effective, a suitable light weight handle should weigh less than about 72 g, preferably less than about 50 g, more preferably less than about 40 g, and even more preferably less than about 35 g.

The handle may be comprised of a variety of materials and combinations thereof providing that the handle is strong, rigid and relatively light. Suitable materials include, for example, metals such as aluminum, steel alloys and titanium; composite materials such as graphite fiber/resin and fiberglass/resin; ceramics; polymeric materials such as thermoset plastics; and/or combinations of two or more thereof. In general, moldable materials that lend flexibility to the handle's size and shape are preferred. Graphite fiber composites are more preferred from a cost, strength, flexibility and availability perspective.

The attachment means can vary and may comprise any conventional mechanism for connecting two tubular objects together. A suitable attachment means includes an interface that cooperates with the handle and shaft to facilitate interengagement. In the preferred embodiment, the interengagement comprises a mechanical engagement, such as, for example, an interference fit, screw engagement (cooperating threads), snapping or latching engagement, crimping engagement, spline and groove engagement, and combinations of two or more thereof. As an alternative to or in combination with mechanical engagement, the interface may enable other means of connection, such as welding, brazing, soldering, and adhesives or fasteners, and combinations of two or more thereof, to be used to connect the handle to the shaft.

For example, the attachment means may comprise a cylindrical stump extending from the handle end. The stump may be dimensionally configured to matingly interfit within the club shaft over a predetermined engagement length. Alternatively, the stump may contain a cavity or socket adapted to receive the end of the club shaft. The stump can be connected to the shaft through mechanical engagement such as an interference fit, and/or through adhesive engagement. In one preferred embodiment, wherein a composite handle is used, this joint is held together by a combination of epoxy and an interference fit.

An interference fit works particularly well if the shaft is a yieldable metal, such as steel, and the handle is an elastic composite such as graphite. For example, a club shaft having a slightly smaller outer diameter than the inner diameter of the handle stump can be interfitted within the stump. In one embodiment, a steel-shaft club, is yieldably expanded in diameter via a mechanical or hydraulic means, ting a permanent set to an outer diameter slightly larger than the handle stump inner diameter. The graphite stump, being only elastically expanded, does not take a permanent set, and squeezes the shaft tightly as it attempts to return to its original diameter under the internal elastic forces. In a more preferred embodiment, a material having a low Modulus of Elasticity such as Kevlar® cord (Dupont, Parkersburg, Va.) is wrapped under tension around the stump of the handle, causing the stump to bear down on the shaft thus increasing the friction of the interference fit.

The handle could also be crimped on the shaft. This technique works well if both the shaft and the handle comprise yieldable metals such as steel. The club shaft is interfitted into the handle, or vice versa, and a crimp is formed in the metal in the region of overlap between handle and shaft, locking the two together by yieldably deforming the metal of both pieces simultaneously. Swaging of the handle to the shaft is also possible. Still other means as attaching the handle to the shaft, other than those disclosed herein, should be obvious to one skilled in the art.

The present invention also provides for a golf club that employs the handle as described above. In the preferred embodiment, the club's shaft is comprised of a structurally rigid material such as a metal alloy, for example, steel. Thus, a user can enjoy a club having the torsional stiffness of a steel shaft with a lower center of gravity traditionally only realized with graphite-shaft clubs (See Comparative Example).

Another aspect of the present invention is a method of attaching the handle of the present invention to an existing golf club. The method comprises the steps of: (a) providing a handle comprising an elongated tubular member having a predetermined length, first and second ends, and an expanded outer surface comprising a gripping surface, the handle further comprising an attachment means disposed proximate to the first end; (b) providing a golf club shaft adapted to receive the handle; and (c) interengaging the attachment means with the golf club shaft thereby attaching the handle to the golf club shaft. It should be noted that the handle and the attachment means identified in step (a) are discussed above in detail, and the variations and alternative embodiments discussed therein apply herein as well. Moreover, in step (b), adapting the shaft to receive the handle may entail removing a preexisting grip and a predetermined segment from the golf club shaft. The segment removed should be of a length such that, when the handle is attached, the club has a desired overall length. In step (c), various techniques may be employed to secure the handle to the shaft, several of which are discussed above. By performing the aforementioned method, the weight of an existing golf club is reduced and the center of gravity is lowered.

The lowered center of gravity of the club will alter the "feel" of the club. This feel can be quantified in terms of swing weight which is measured typically using the Lorythmic Swing Weight Scale Standard. For a club of a given length, the swing weight will increase as the center of gravity moves toward the club's head. Therefore, since the present invention dramatically affects a club's center of gravity and thus swing weight, modifications to the club may be necessary if a user prefers to maintain the same swing weight of an existing club, or, if the user simply desires less swing weight. Methods of reducing swing weight include, for example, shortening the club, reducing weight in the head, adding weight to the handle and combinations of two or more thereof. In a preferred embodiment of the process, swing weight is reduced by shortening the length of the club. Generally, shorter clubs are easier to control. Furthermore, with the lower center of gravity afforded by the light-weight handle of the present invention, the club mass will be more effective in transferring momentum to the ball.

Referring now to the figures, a discussion of the above features in regard to preferred embodiments is provided below. It should be understood that such embodiments are for illustrative purposes, and should not be construed as limiting the scope of the invention.

Figure 2:
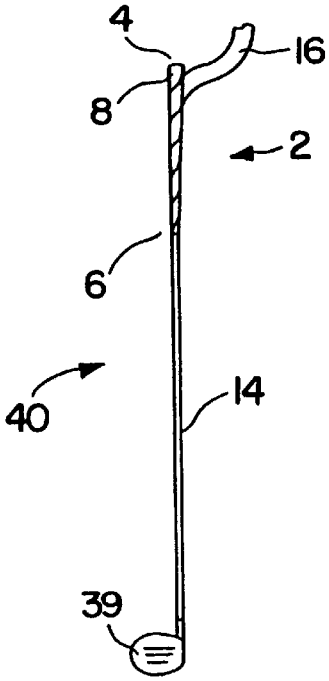
FIG. 2 shows a golf club according to the invention.

FIG. 1 shows a handle 2 according to the invention comprising an elongated tubular member having a second or butt end 4, a first end 6 oppositely disposed, and an outer surface 8. The outer surface is expanded radially to comprise a gripping surface having a predetermined circumference 10 tailored to fit comfortably in a golfer's hands and afford a sure hold on handle 2. To better facilitate manual gripping of handle 2, a gripping layer 16 is applied to outer surface 8. An attachment means 12*a* is disposed proximate to first end 6, and provides the means for interengaging a club shaft 14 when handle 2 is assembled into a club as seen in FIG. 2. The attachment means can assume various forms which are described below in conjunction with the attachment of handle 2 to shaft 14.

In one preferred embodiment, the handle is comprised of a composite material. The handle 2 illustrated in FIG. 1 can be manufactured, for example, from graphite-epoxy or a similar composite by winding a high elastic modulus fiber under tension in a combination resin matrix of helix patterns over a tapered steel mandrel. This well known technique for producing composite tubular articles yields a high strength light-weight handle with excellent bending and torsional stiffness properties.

In a preferred embodiment, at least a portion of the handle is hoop wrapped, preferably with a material having a low modulus of elasticity such as Kevlar®. The hoop wrap serves a number of purposes. First, it prevents the handle from splitting particularly where the handle attaches to the shaft. Second, it squeezes excess epoxy or other binding material from the handle thereby lightening the handle. Third, it provides the handle with a finish suitable for gripping—the need for sanding or otherwise finishing is reduced or eliminated.

The relatively large diameter of the handle, in addition to accommodating the golfer's hands comfortably, accounts for the advantageous torsional stiffness since the torsional stiffness is proportional to the fourth power of the diameter of a circular section. A high bending stiffness also results from the large diameter, since the bending stiffness is proportional to the area moment of inertia which is proportional to the square of the is diameter of a circular section.

Figure 3:
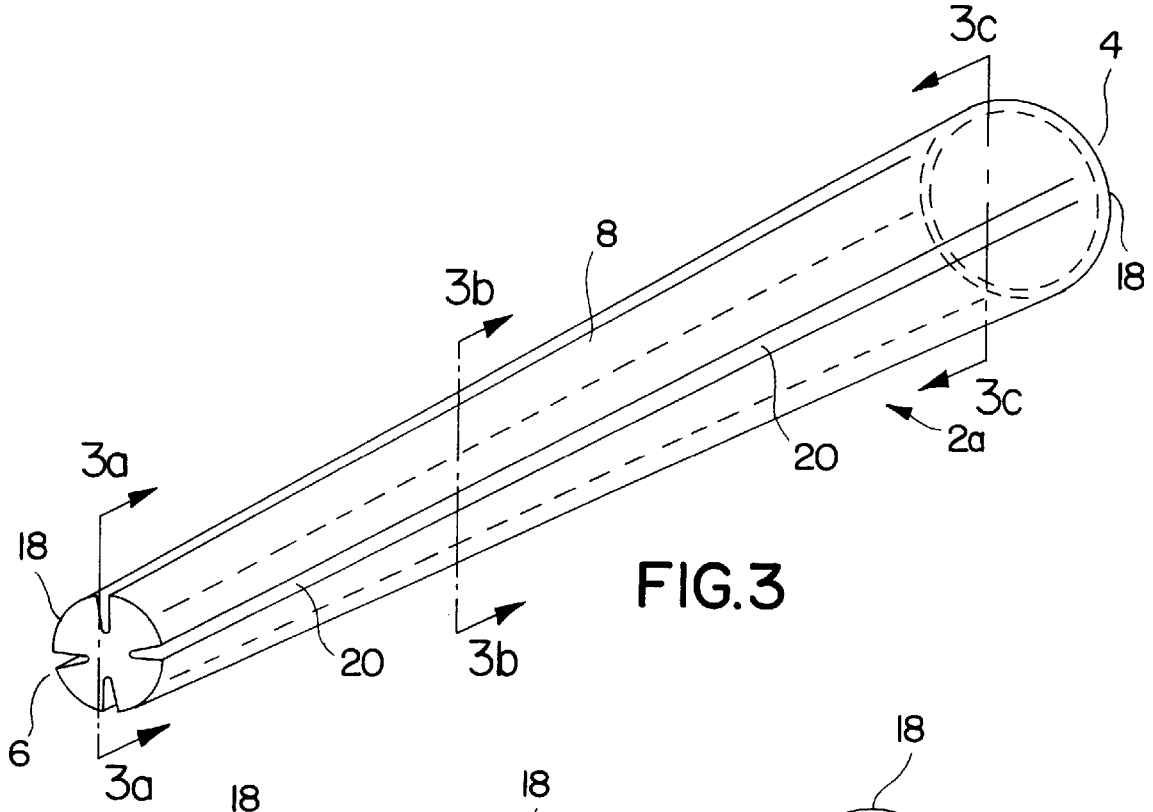
FIG. 3 shows an isometric view of a second embodiment of a handle according to the invention.
Figure 3A:
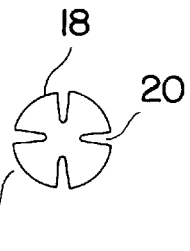
Figure 3B:
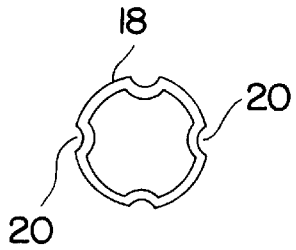
Figure 3C:
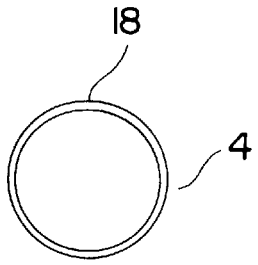
Figure 6:
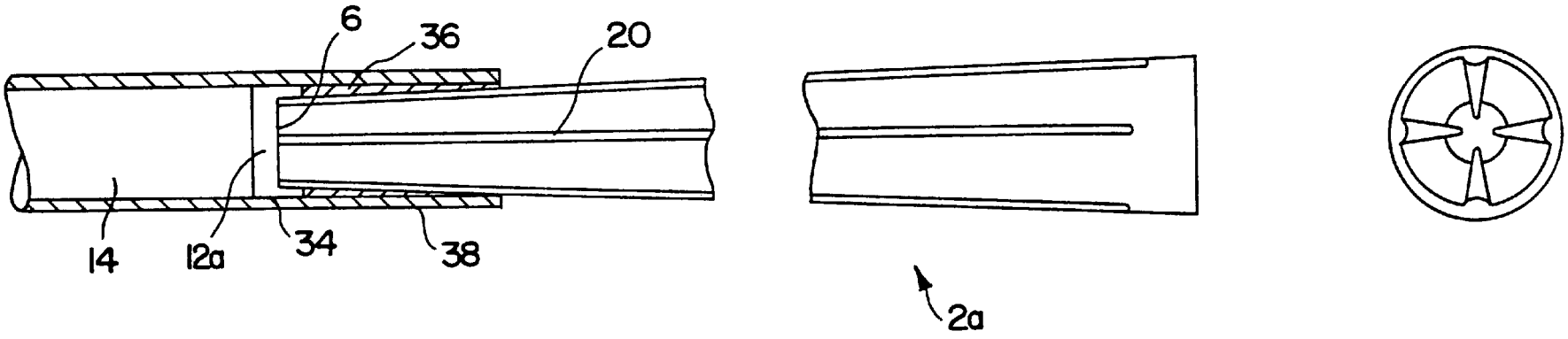
FIG. 6 shows a longitudinal sectional view detailing yet another mode of attachment of a handle to a club shaft according to the invention.

Another preferred embodiment of the handle is illustrated in FIG. 3 and denoted 2*a*. Handle 2*a* is made of a yieldably workable metal such as a steel alloy. The elongated tubular member has a side wall 18 which is folded circumferentially in a series of crenellations 20, which extend lengthwise along the handle, preferably from near the butt end 4 to the first end 6. FIGS. 3*a*, 3*b*, and 3*c* display cross sectional views at various sections along handle 2*a* illustrative of the crenellations 20 and their variation as a function of length along the tubular member. The crenellations 20 are imperceptible at butt end 4 (see FIG. 3*c*) and gradually deepen at the mid point (FIG. 3*b*) becoming most pronounced at the first end 6 (FIG. 3*a*). By gradually deepening the folds of the crenellations 20, it is possible to effect a tapered profile of handle 2*a*, thus providing for a radially expanded handle 2*a* affording a comfortable hand grip which tapers to provide the wedging action desired for a club handle and providing a first end 6 which can interengage a club shaft 14 as shown in FIG. 6, to be discussed later in detail.

Alternately folding wall 18 to form the crenellations 20 provides handle 2*a* with increased bending stiffness, strength, and resistance to buckling over a smooth wall design. The advantage secured by the crenelated wall is due to the increase in the cross sectional area moment of inertia, allowing relatively thin gauge steel, on the order of 0.008 to 0.010 to be used. In the preferred embodiment, the crenelated handle 2*a* is formed by placing a smooth wall tubular steel blank within an elongated female die having the crenelation pattern contour formed along the length of the die. A male mandrel die with a mating crenelation pattern is then forced into the female die sandwiching the smooth wall tubular blank between mating dies. The wall of the tubular blank is forced to fold into the crenelated pattern as the dies are mated together. The male die is then removed from the female and the formed crenelated handle 2*a* is removed as well.

Figure 4:
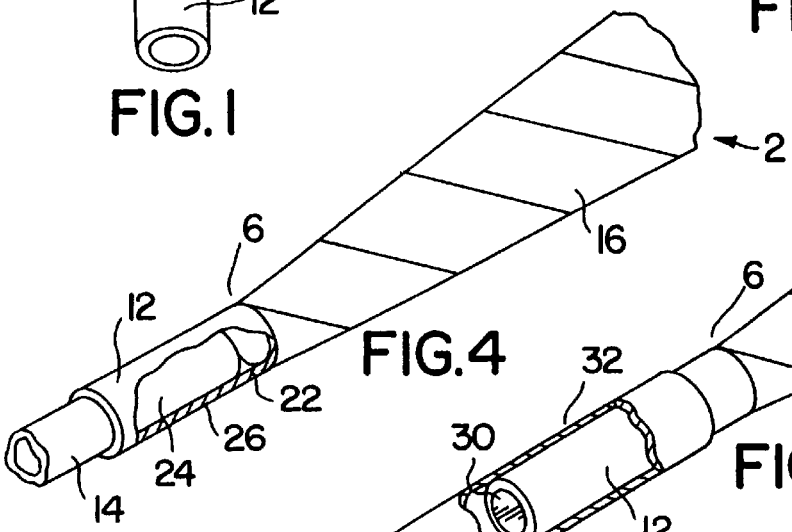
FIG. 4 shows an isometric cutaway view detailing the attachment of a handle to a club shaft according to the invention.

As shown in FIG. 1, handle 2 has an attachment means 12 proximately disposed at end 6. Preferably, attachment means 12 is cylindrical in shape and forms a stump extending from end 6 which is an integral part of handle 2. Stump 12 interengages shaft 14 to effect the attachment of the handle to the shaft. There are several modes of attachment illustrated in FIGS. 4 and 5. In FIG. 4, stump 12 has a cavity 22 formed within the stump which matingly accepts shaft 14 over an engagement length 24. Shaft 14 is preferably retained within cavity 22 by an adhesive layer 26, preferably an epoxy, interposed between the shaft and cavity as is well understood in the art. Alternatively, shaft 14 could be retained by radially expanding engagement length 24 after insertion into cavity 22 thus causing an interference fit to develop. To create the interference fit, engagement length 14 is yieldably expanded to take a permanent set at a diameter larger than the diameter of cavity 22. Although stump 12 also expands, it remains in the elastic stress range and elastic forces within the stump which try to return the stump to its original diameter cause the stump to grip the shaft 14 tightly over its engagement length 24. Engagement length 24 is expanded by hydraulic means or preferably by the mechanical means of forcing an expanding mandrel into shaft 14 over engagement length 24.

Figure 5:
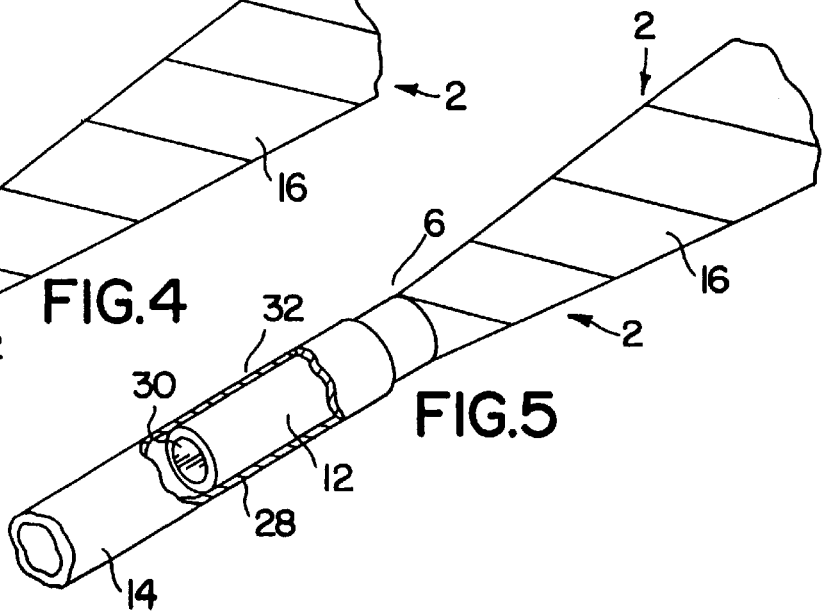
FIG. 5 shows an isometric cutaway view detailing another mode of attachment of a handle to a club shaft according to the invention.

FIG. 5 illustrates another alternative method of attachment of handle 2 to shaft 14. Stump 12 is matingly inserted into shaft 14. An adhesive layer 28, preferably epoxy, is sandwiched between stump 12 and shaft 14 to retain handle 2 to shaft 14. A reinforcing button 30 is mounted distally within stump 12 to prevent the end of the stump from collapsing when the stump is inserted into the shaft. Alternatively, shaft 14 could be swaged or crimped to retain handle 2 by yieldingly crushing or crimping shaft 14 over the engagement region 32 where the shaft overlaps stump 12.

Handle 2*a* (shown in FIGS. 3 and 6) preferably tapers over its entire length and has a different attachment means for interengaging shaft 14. The attachment means, denoted 12*a* in FIG. 6 comprises a centering plug distally mounted on end 6 of handle 2*a*. Centering plug 12*a* is preferably round in shape and adhesively attached to handle 2*a* via epoxy. Centering plug 12*a* provides for mating interengagement with shaft 14, and prevents the tapered end 6 from cocking out of alignment with shaft 14 when the handle 2*a* is inserted into shaft 14 as shown in FIG. 6. Centering plug 12*a* is retained to shaft 14 preferably by means of an adhesive layer 34 between the plug and the shaft, and adhesive 36 is also injected into the region between handle 2*a* and shaft 14 formed by the tapered end 6 of handle 2*a* and the straight side wall 38 of shaft 14. Centering plug 12*a* also serves to confine adhesive 36 to the region within the shaft overlapping handle 2*a*.

FIG. 2 shows a golf club 40 as the present invention. It comprises a handle 2, shaft 14, and head 39. The handle preferably is with a tape 16 to enhance its gripping surface. The shaft may be comprised of any suitable, known material, although a torsionally rigid material such as steel is preferred.

COMPARATIVE EXAMPLE

This example compares the overall weight of prior art club configurations designs (Columns 1–3) with clubs having a handle according to the present invention (Columns 4,5).

TABLE 2

COMPARISON OF CLUB WEIGHTS

| Club Description | 1 Rubber Grip/ 43" Steel Shaft | 2 Rubber Grip/ 45" Graphite Shaft | 3 45" Gripless Graphite Shaft | 4 Light Weight Graphite Handle Steel Shaft* 43–47" total | 5 Light Weight Graphite Handle Graphite Shaft* 43–47" total |
|---|---|---|---|---|---|
| Torsional Deflection (Degrees) | very small | 2.5 to 6.0 | 2.5 to 6.0 | very small | 2.5 to 6.0 |
| Grip | 50 g | 38–50 g | n/a | n/a | n/a |
| Handle | n/a | n/a | n/a | 30 g | 30 g |
| Shaft | 115 g | 55–65 g | 65 g | 82 g | 50 g |
| Tape | n/a | n/a | 10 g | 10 g | 10 g |
| Head | 200 g | 200 g | 200 g | 200 g | 200 g |
| Total | 365 g | 293–315 g | 275 g | 322 g | 290 g |

*Approximately 9 inches removed from butt end of shaft.

As shown, the light weight graphite-handle/graphite-shaft club (Item 5 above) of the present invention has a club weight significantly lower than that of both the traditional-grip/steel-shaft club (Item 1) and the traditional-grip/graphite-shaft club (Item 2), and is comparable to the gripless graphite shaft club (Item 3). Since these clubs have the same head weight, any reduction in the overall weight lowers the center of gravity.

The light weight graphite-handle/steel-shaft club (Item 4) of the present invention also has a lower overall weight than the traditional-grip/steel-shaft club (Item 1) and has approximately the same weight as the traditional-grip/graphite-shaft club (Item 2). Moreover, the light weight graphite-handle/steel-shaft has a higher torsional stiffness than the other graphite-shaft clubs. This avoids the problem of head rotation relative to the shaft during impact with the ball which can cause it to veer from the intended path, as discussed previously. Thus, a steel-shaft club fitted with a light weight handle according to the invention attains the weight advantage of the graphite-shaft club with a conventional grip without sacrificing the torsional stiffness of the steel-shaft club.

What is claimed is:

1. A method of attaching a handle to a golf club, said method comprising the steps of:

providing a handle comprising a substantially elongated tubular member having a predetermined length, first and second ends, and an expanded outer surface comprising a gripping surface, said handle further comprising an attachment means disposed proximate to said first end;

providing a golf club shaft;

removing a preexisting grip and a predetermined segment from said golf club shaft, wherein said grip and said segment have a combined weight greater than the weight of said handle; and interengaging said attachment means with the golf club shaft thereby attaching said handle to the golf club shaft.

2. The method of claim 1, wherein said attachment means comprises a stump extending longitudinally from said handle, said stump having a cavity disposed therein, said cavity being adapted to accept the golf club shaft in mating interengagement, and said interengaging step comprises inserting the golf club shaft into said cavity.

3. The method of claim 2, wherein interengaging said attachment means comprises tightly wrapping said stump with material having a Modulus of elasticity lower than that of said stump.

4. The method of claim 1, further comprising:

adjusting swing weight of said club.

5. A method of moving the center of gravity of a golf club toward its head, said golf club having a head, shaft and grip, said method comprising the steps of:

removing said grip and a predetermined segment of said shaft;

providing a handle comprising a substantially tubular member having a predetermined length, first and second ends, and a radially expanded outer surface comprising a gripping surface, said handle further comprising an attachment means disposed proximate to said first end for facilitating interengagement with the shaft of the golf club, said handle weighing less than the combination of said grip and said segment;

interengaging said attachment means with the golf club shaft thereby attaching said handle to the golf club in place of said grip and said segment of said shaft.

* * * * *